US006386697B1

(12) United States Patent
Yamamoto et al.

(10) Patent No.: US 6,386,697 B1
(45) Date of Patent: May 14, 2002

(54) IMAGE FORMING DEVICE INCLUDING INTERMEDIATE MEDIUM

(75) Inventors: Takemi Yamamoto; Takeshi Asano, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/309,896

(22) Filed: May 11, 1999

(30) Foreign Application Priority Data

May 12, 1998 (JP) ..... 10-128692

(51) Int. Cl.[7] ..... B41J 2/01
(52) U.S. Cl. ..... 347/103; 347/101
(58) Field of Search ..... 347/103; 399/302, 399/303, 308

(56) References Cited

U.S. PATENT DOCUMENTS 5,519,475 A * 5/1996 Miyamoto et al. ..... 355/271
5,886,727 A * 3/1999 Dobashi et al. ..... 347/103
5,899,610 A * 5/1999 Enomoto et al. ..... 399/302
6,201,945 B1 * 3/2001 Schlueter, Jr. et al. ..... 399/329

FOREIGN PATENT DOCUMENTS

JP A-3-242667 10/1991 ..... 347/172
JP A-7-17030 1/1995 ..... 347/103

* cited by examiner

*Primary Examiner*—John Barlow
*Assistant Examiner*—An H. Do
(74) *Attorney, Agent, or Firm*—Oliff & Berridge, PLC

(57) ABSTRACT

To provide an intermediate medium capable of forming an image without gloss and also to provide an image forming device including the intermediate medium. The transfer belt 11 is produced from polyimide by molding techniques using a mold having a surface roughness Rz of between 5 $\mu$m and 50 $\mu$m. Therefore, the transfer belt 11 produced in this manner also has surface roughness Rz of between 5 $\mu$m and 50 $\mu$m. An ink image is first formed onto the transfer belt 11, and then, transferred onto a recording sheet S by application of heat and pressure. In this way, an ink image without gloss can be obtained.

23 Claims, 3 Drawing Sheets

IMAGE FORMING DEVICE INCLUDING INTERMEDIATE MEDIUM

BACKGROUND OF THE INVENTION

1. Field of the Invention

The present invention relates to an image forming device including an intermediate medium, wherein an image is first formed on the intermediate medium, and then transferred onto a recording medium by application of heat and/or pressure.

2. Description of the Related Art

This type of image forming device includes ink jet printers, thermal-transfer printers, and electrostatic printers, and is capable of reliably forming a high-quality multicolor image.

In order to effectively transfer the image from the intermediate medium onto the recording medium, the intermediate medium is processed to have a smooth surface. This is particularly true in an ink jet printer using phase-changeable ink and in a thermal-transfer printer.

For example, Japanese Patent Application Publication (Kokai) No. HEI-3-242667 discloses an image forming device including an intermediate medium, wherein an image formed on the intermediate medium is thermally transferred onto a recording medium. The intermediate medium is formed from a silicon elastomer to have a smooth surface that has a roughness with a maximum height Rmax of 10 $\mu$m or less.

The image formed on the recording medium in this manner will have a smooth surface because surface roughness of the image depends on the surface roughness of the intermediate medium. The smooth surface of the image gives the printed image a glossy texture.

However, there are those who prefer silk images without gloss. In fact, there is known a silver halide photographic recording method for providing silk images. However, as described above, the smooth surface of the intermediate medium gives the printed image a glossy texture.

SUMMARY OF THE INVENTION

It is an objective of the present invention to provide an intermediate medium capable of providing a silk image without gloss and an image forming device including the intermediate medium.

In order to achieve the above and other objectives, there is provided a transfer device including an intermediate medium and a transfer unit. The intermediate medium has a surface having a surface roughness Rz of between 5 $\mu$m and 50 $\mu$m. The surface of the intermediate medium is formed with an image of phase-changeable ink. The transfer unit transfers the image from the intermediate medium onto a recording medium.

There is also provided an image forming device including an intermediate medium, an image forming unit, and a transfer unit. The intermediate medium has a surface roughness Rz of between 5 $\mu$m and 50 $\mu$m. The image forming unit forms an image onto the intermediate medium using phase-changeable ink. The transfer unit transfers the image from the intermediate medium onto a recording medium.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Ink jet printers according to preferred embodiments of the present invention will be described while referring to the accompanying drawings. In the following description, the expressions "above" and "below" are used throughout the description to define the various parts when the ink jet printers disposed in an orientation in which the ink jet printers are intended to be used.

It should be noted that the ink jet printers use phase-changeable ink, such as hot melt ink, that has a melting point of between 80° C. and 90° C.

Figure 1:
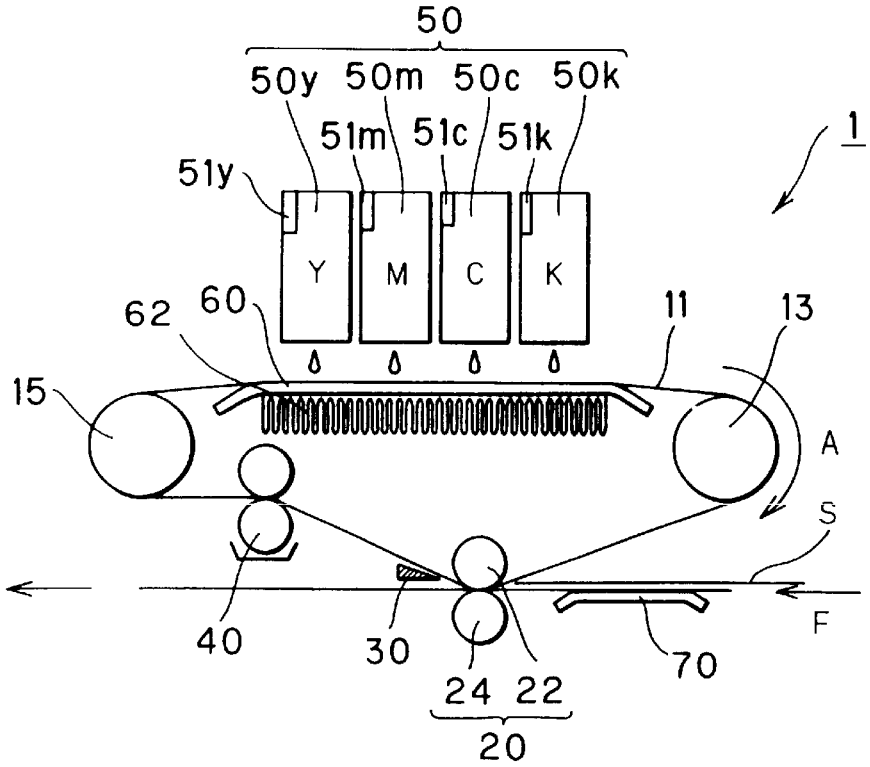
FIG. 1 is a plan view showing a configuration of an ink jet printer according to a first embodiment of the present invention.

First, an ink jet printer 1 according to a first embodiment of the present invention will be described while referring to FIG. 1. As shown in FIG. 1, the ink jet printer 1 includes a transfer belt 11, a drive roller 13, a tension roller 15, a transfer unit 20, a separation pawl 30, a cleaning roller 40, a head unit 50, a guide plate 60, a cooling fins 62, and a heater 70.

The drive roller 13 and the tension roller 15 are rotatably disposed at positions separated from each other. The transfer belt 11 has an endless belt shape. The transfer belt 11 is wound around and spans between the drive roller 13 and the tension roller 15. As the drive roller 13 is driven to rotate, the transfer belt 11 is transported in a transport direction indicated by an arrow A.

The transfer belt 11 is produced from polyimide by molding techniques using a mold that has a surface roughness Rz of 10 $\mu$m or greater. Therefore, the transfer belt 11 also has a surface roughness Rz of 10 $\mu$m or greater. The surface of the transfer belt 11 is coated with Teflon.

The transfer unit 20 includes a heat roller 22 and a pressing roller 24. The heat roller 22 and the pressing roller 24 are disposed so as to sandwich a portion of the transfer belt 11 therebetween. The heat roller 22 is for generating heat. The pressing roller 24 is for pressing against the heat roller 22 with pressure of between 10 and 100 kgf/cm$^2$.

The separation pawl 30 is disposed downstream side of the transfer unit 20 in the transport direction A and is for separating a recording sheet S from the transfer belt 11 in a manner to be described later. The cleaning roller 40 is positioned between the separation pawl 30 and the tension roller 15 for cleaning the transfer belt 11.

The head unit 50 is disposed above the transfer belt 11, and includes ink jet heads 50*y*, 50*m*, 50*c*, 50*k* arranged in this order in the transport direction F. The ink jet heads 50*y*, 50*m*, 50*c*, 50*k* store corresponding colored inks, that is, yellow-color ink, magenta-color ink, cyan-color ink, black-color ink, respectively. Also, heaters 51*y*, 51*m*, 51*c*, 51*k* are provided to corresponding ink jet heads 50*y*, 50*m*, 50*c*, 50*k* for generating heat so as to melt the ink stored therein. The ink jet heads 50*y*, 50*m*, 50*c*, 50*k* each has a nozzle surface formed with nozzles through which melted ink is ejected as ink droplets toward the transfer belt 11.

The guide plate 60 is disposed so as to confront the head unit 50 on the other side of a portion of the transfer belt 11. The cooling fins 62 have a large surface area for cooling the transfer belt 11, and are mounted on the guide plate 60.

Although not shown in the drawings, the ink jet printer 1 further includes a sheet feed mechanism for feeding a recording sheet S in a sheet feed direction indicated by an arrow F. The heater 70 is for generating heat and is positioned on the upstream side of the pressing roller 24. When a recording sheet S is supplied from upstream in the sheet feed direction F, the heater 70 guides the recording sheet S toward the transfer unit 20 while heating up the recording sheet S.

Next, operations performed by the ink jet printer 1 will be described. The ink stored in the head unit 50 is maintained at a temperature of between 120° C. and 130° C. to maintain a viscosity of approximately 20 cpa. First, ink droplets are selectively ejected from the ink jet head 50*y*, 50*m*, 50*c*, 50*k* onto the transfer belt 11. The ink is immediately cooled down by effect of the cooling fins 62, and solidifies. In this way, an ink image is formed on the transfer belt 11. As the drive roller 13 is driven to rotate, the ink image on the transfer belt 11 is transported toward the transfer unit 20 in the transport direction A.

At the same time, the sheet feed mechanism feeds a recording sheet S toward the heater 70 in the sheet feed direction F. The recording sheet S is heated by the heater 70 to a temperature approximately equal to the melting point of the ink, that is, between 80° C. and 90° C. in this example. The recording sheet S is further fed toward the transfer unit 20 as guided by the heater 70. Then, the recording sheet S is supplied to a nip portion defined between the heat roller 22 and the pressing roller 24 by the time when the ink image reaches the transfer unit 20.

When both the ink image and the recording sheet S reach the transfer unit 20, the ink image is sandwiched between the transfer belt 11 and the recording sheet S. At this time, the ink image is applied with heat generated by the heat roller 22, and is heated to a temperature between 50° C. and 70° C. As a result, the ink, which is forming the ink image, is softened, and a portion of the ink which is in contact with the recording sheet S is heated almost to its melting point. Then, a surface portion of the ink image is in its molten state. When the pressing roller 24 applies pressure to the ink image in this condition, the melted surface portion of the ink image is absorbed into the recording sheet S.

Then, as the transfer belt 11 and the recording sheet S are further transported in the transport direction A and the sheet feed direction F, respectively, the recording sheet S is asparated from the transfer belt 11 by the separation pawl 30. At this time, because adhesive force between the ink image and the recording sheet S is greater than adhesive force between the ink image and the transfer belt 11, the ink image is transferred from the transfer belt 11 onto the recording sheet S.

Then, the recording sheet S formed with the ink image is discharged out of the ink jet printer 1. On the other hand, the transfer belt 11 is further transported toward the cleaning roller 40, and the cleaning roller 40 cleans the surface of the transfer belt 11 to remove any untransferred ink remaining on the transfer belt 11.

Because the ink image formed on the recording sheet S has a surface roughness approximately equal to the surface roughness of the transfer belt 11, the ink image has the surface roughness Rz of 10 $\mu$m or greater in this example. The ink image with this surface roughness will be a silk print image without gloss.

As described above, according to the first embodiment of the present invention, because the surface roughness Rz of the transfer belt 11 is set to 10 $\mu$m or greater, a silk image can be obtained on the recording sheet S. Also, because the transfer belt 11 is coated with Teflon, the ink image can be effectively transferred from the transfer belt 11 onto the recording sheet S although the transfer belt 11 is formed to have a relatively great surface roughness.

Also, because the transfer belt 11 is used as an intermediate medium, components of the ink jet printer 1 can be arranged in a simple manner.

It should be noted that surface roughness Rz is measured in the following manner. First, cross-section of the subject member is obtained. Next, the average height of all peaks and valley is determined and represented by an average line. Then, the five highest peaks and the five lowest valley in the cross-sectional length are determined based on the distance from a base line. Then, an average of the five lowest valleys and an average of five greatest peaks are obtained. The surface roughness Rz represents the difference between these averages.

Figure 2:
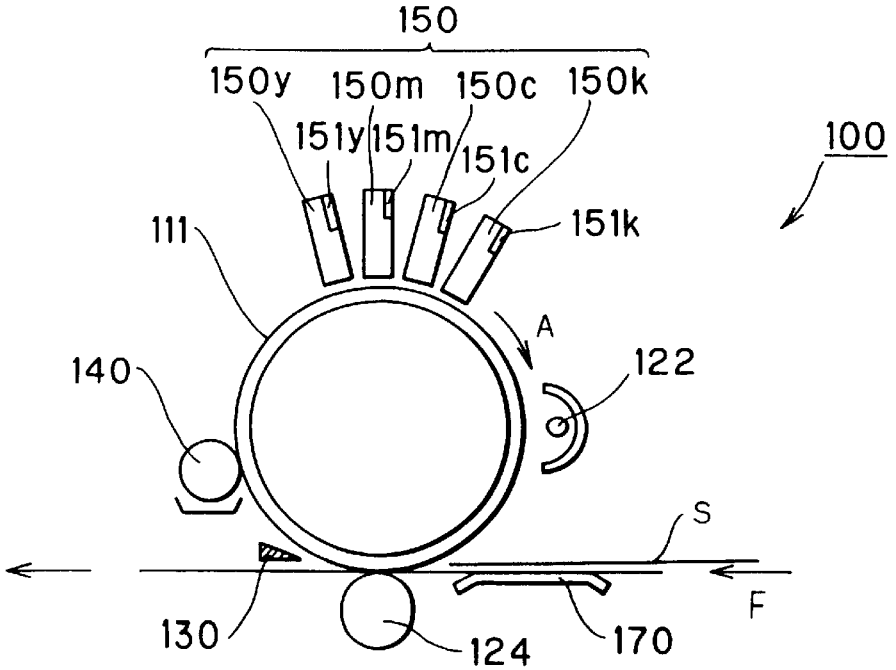
FIG. 2 is a plan view showing a configuration of an ink jet printer according to a second embodiment of the present invention.

Next, an ink jet printer 100 according to a second embodiment of the present invention will be described while referring to FIG. 2. As shown in FIG. 2, the ink jet printer 100 includes a transfer drum 111, a drum heater 122, a pressing roller 124, a separation pawl 133, a cleaning roller 140, a head unit 150, and a paper heater 170.

The transfer drum 111 is rotatable in the transport direction A. The head unit 150 includes ink jet heads 150*y*, 150*m*, 150*c*, 150*k*, storing yellow colored ink, magenta colored ink, cyan colored ink, black colored ink, respectively. Heaters 151*y*, 151*m*, 151*c*, 151*k* are provided to corresponding ink jet heads 150*y*, 150*m*, 150*c*, 150*k* for generating heat so as to melt the ink stored therein. The ink jet heads 150*y*, 150*m*, 150*c*, 150*k* each has a nozzle surface formed with nozzles through which melted ink is ejected as ink droplets. The ink jet heads 150*y*, 150*m*, 150*c*, 150*k* are disposed above the transfer drum 111 such that the nozzle surfaces face the transfer drum 111.

The drum heater 122 is for generating heat and is disposed at the downstream side of the head unit 150 in the transport direction A. The pressing roller 124 is disposed below the transfer drum 111 so as to press against the transfer drum 111 with a pressing force of between 10 and 100 kgf/cm$^2$. The separation pawl 130 and the cleaning roller 140 are disposed at the downstream side of the pressing roller 124 in the transport direction A in this order. The cleaning roller 140 is for cleaning the surface of the transfer drum 111 and also for applying silicon oil onto the surface of the transfer drum 111 so as to form a thin silicon oil film over the transfer drum 111. The thin silicon oil film serves as an ink repellent layer to facilitate an ink image to transfer from the transfer drum 111 onto a recording sheet S.

The ink jet printer 100 further includes a sheet feed mechanism (not shown) for feeding a recording sheet S in the sheet feed direction F. The sheet heater 170 is for generating heat and guiding a recording sheet S toward a nip portion defined between the transfer drum 111 and the pressing roller 124.

The transfer drum 111 is formed from a metal with a great thermal conductivity, such as aluminum or iron. Also, the peripheral surface of the transfer drum 111 is processed to have a surface roughness Rz of 10 μm or greater by a shot blast method, for example.

Next, operations performed by the ink jet printer 100 will be described. Ink is maintained within the head unit 150 at a temperature of between 120 and 130 and a viscosity of approximately 20 cps. Each of the ink jet heads 150*y*, 150*m*, 150*c*, 150*k* selectively ejects ink droplets toward the surface of the transfer drum 111 which is covered with a thin silicon oil film. In this way, an ink image is formed on the transfer drum 111. Rotational movement of the transfer drum 111 transports the ink image in the transport direct A. When the ink image reaches the drum heater 122, the surface portion of the ink image is heated to a temperature of between 50° C. and 70° C. by the drum heater 122. Then, the ink image is further transported toward the nip portion between the transfer drum 111 and the pressing roller 124.

At the same time, a recording sheet S is heated by the paper heater 170 to a melting temperature of the ink, that is, a temperature between 70° C. and 80° C. in this example. Then, the recording sheet S is supplied to the nip portion by the time the ink image reaches the nip portion, and the ink image comes into contact with the recording sheet S. Because the recording sheet S has been heated in the above-described manner, the ink image is heated by the recording sheet S so that the surface portion of the ink image is in a molten state. When the pressing roller 124 applies pressure to the ink image in this condition, the melted surface portion of the ink image is absorbed into the recording sheet S. Next, the recording sheet S is separated from the transfer drum 111 by the separation pawl 130. At this time, the ink image is transferred from the transfer drum 111 to the recording sheet S along with the thin silicon oil film. This is because the adhesive force between the ink image and the recording sheet S is greater than the adhesive force between the ink image and the thin silicon oil film formed over the surface of the transfer drum 111.

Because a surface roughness of an ink image formed on a recording sheet S is approximately equal to that of the transfer drum 111, the ink image will have a surface roughness Rz of 50 μm or greater, in this example. In this way, a silk print image without gloss can be formed.

Also, because the surface of the transfer drum 111 is coated with a thin silicon oil layer, an ink image can be effectively transferred from the transfer drum 111 onto a recording sheet S although the transfer drum 111 has a relatively great surface roughness.

Further, because the ink jet printer 100 includes the transfer drum 111 as the intermediate medium, a multicolor image can be reliably formed without shifting between colors. Also, the transfer drum 111 can be transported at a relatively high speed.

Figure 3:
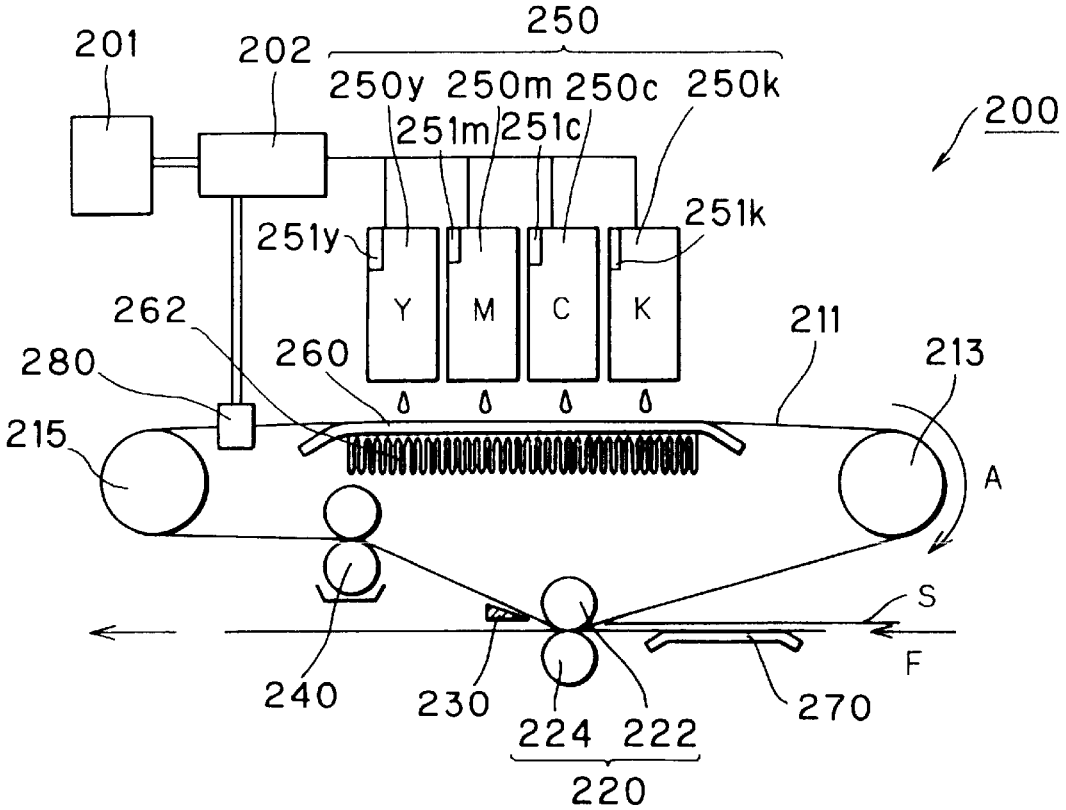
FIG. 3 is a plan view showing a configuration of an ink jet printer according to a third embodiment of the present invention.

Next, an ink jet printer 200 according to a third embodiment of the present invention will be described while referring to FIGS. 3 and 4. As shown in FIG. 3, a configuration of the ink jet printer 200 is similar to that of the ink jet printer 1 shown in FIG. 1. Specifically, the ink jet printer 200 includes a transfer belt 211, a drive roller 213, a tension roller 215, a transfer unit 220, a separation pawl 230, a cleaning roller 240, a head unit 250, and a sheet heater 270. The head unit 215 includes ink jet heads 250*y*, 250*m*, 250*c*, 250*k* provided with heaters 251*y*, 251*m*, 251*c*, 251*k*, respectively. The transfer unit 220 includes a heat roller 222 and a pressing roller 224. The transfer belt 290 is formed from polyimide, and it surface is coated with Teflon.

Figure 4:
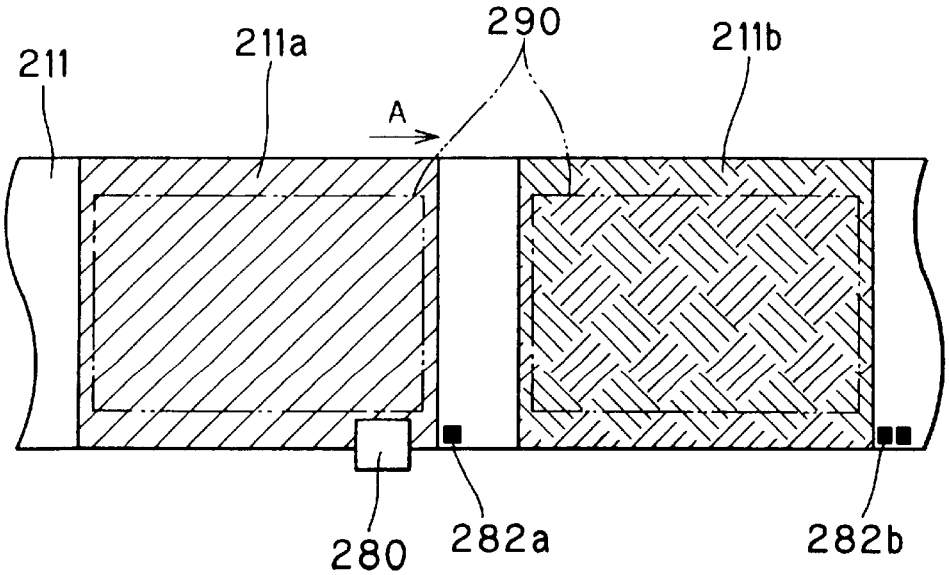
FIG. 4 is a plan view showing a spread transfer belt of the ink jet printer of FIG. 3.

However, as shown in FIG. 4, a transfer belt 211 has a first region 211*a* and a second region 211*b*. A surface roughness Rz of the first region 211*a* is set to 1 μm or less. On the other hand, a surface roughness Rz of the second region 211*b* is set to 5 μm or greater. Also, the transfer belt 211 is formed with holes 282*a*, 282*b* at the leading side of the corresponding first region 211*a* and the second region 411*b* in the transport direction A. The hole 282*a* is formed in a shape or number different from the hole 282*b* so as to be distinguishable from the hole 282*b*.

Also, as shown in FIG. 3, the ink jet printer 200 further includes a control panel 201, a drive circuit 202, and a sensor 280. The drive circuit 202 is connected to each ink jet head 250*y*, 250*m*, 250*c*, 250*k* for controlling the ink jet heads 250*y*, 250*m*, 250*c*, 250*k*. The drive circuit 202 is also connected to the control panel 201 and the sensor 280. Although not shown in the drawings, the control panel 201 is provided with key switches. A user can select a silk printing mode or gloss printing mode of the ink jet printer 200 by operating the key switches. The sensor 280 detects the holes 282*a* and 282*b* and outputs detection signals.

With this configuration, when the gloss printing mode is selected, an ink image is first formed within the first region 211*a* of the transfer belt 290. On the other hand, when the silk printing mode is selected, an ink image is formed within the second region 211*b* of the transfer belt 290. Then, the ink image is transferred onto a recording sheet S from either the first region 211*a* or the second region 211*b* of the transfer belt 290.

Next, operations performed by the ink jet printer 200 will be described. First, either one of the gloss printing mode and the silk printing mode is selected by the user operating the control panel 201. If the gloss printing mode is selected, then when the sensor 280 outputs the detection signal upon detecting the first hole 282*a*, the drive control circuit 202 starts controlling the ink jet heads 250*y*, 250*m*, 250*c*, 250*k* upon receiving the detection signal. The head unit 250 forms an ink image on the transfer belt 290 within the first region 211*a*. The ink image is then transported toward the transfer until 220, and the ink image is transferred on a recording sheet S in the same manner as in the above-described first embodiment. Because the first region 211*a* of the transfer belt 290 has a relatively small surface roughness, a gloss image can be obtained.

On the other hand, when the silk print mode is selected, then when the sensor 280 outputs the detection signal upon detecting the second hole 282*b*, the drive control circuit 202 starts controlling the head unit 250 upon receiving the detection signal. The head unit 250 forms an ink image on the transfer belt 290 within the second region 211*b*. The ink image is transported to the transfer unit 220 and transferred onto a recording sheet S in the same manner. Because the second region 211*b* of the transfer belt 290 has a relatively great surface roughness, a silk image can be obtained.

As described above, the ink jet printer 200 according to the third embodiment can selectively form a silk image or a gloss image in accordance with a user's instruction.

Figure 5:
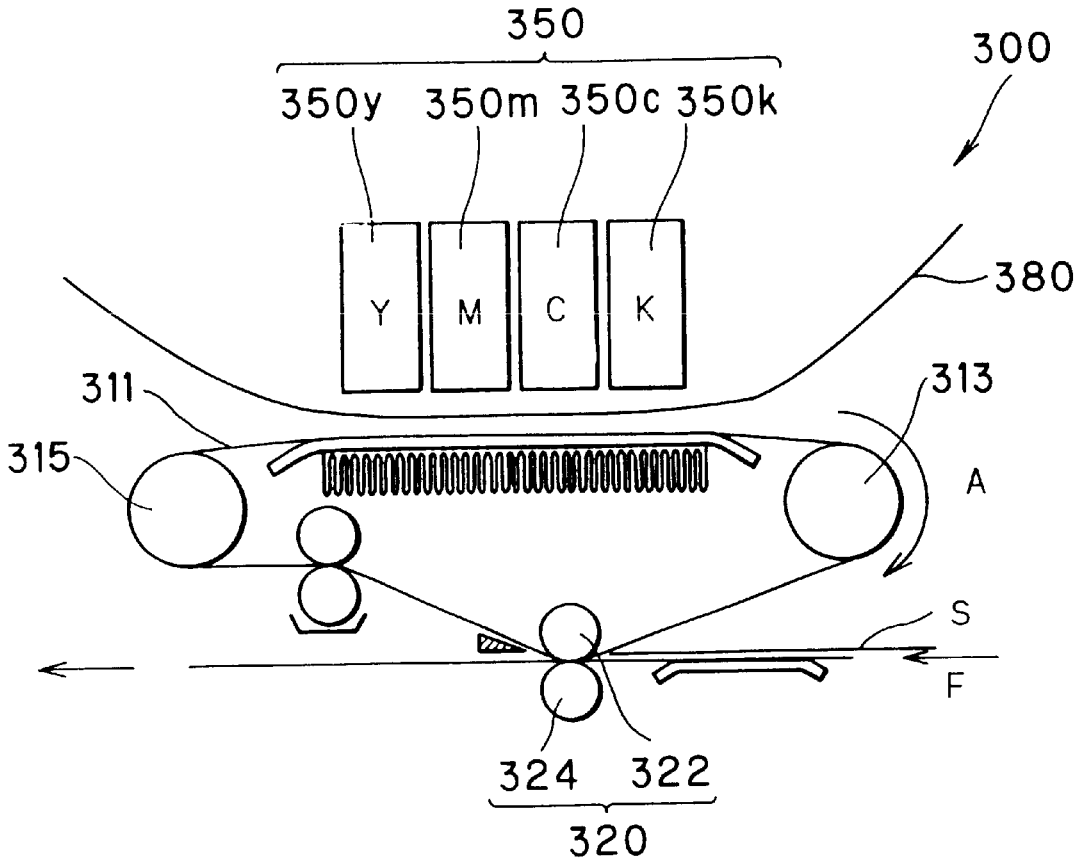
FIG. 5 is a plan view showing a configuration of a thermal printer according to a fourth embodiment of the present invention.

Next, a thermal printer 300 according to a fourth embodiment of the present invention will be described while referring to FIG. 5. As shown in FIG. 5, the thermal printer 300 includes a thermal head unit 350 having thermal heads 350*y*, 350*m*, 350*c*, 350*k* aligned in this order above a transfer belt 311. A thermal transfer ink ribbon 380 is provided between the head unit 350 and the transfer belt 311. The ink ribbon 380 is formed with repeated ink region patterns. The ink region pattern includes colored ink regions, that is, a yellow ink region, a magenta ink region, a cyan ink region, and a black ink region, aligned in this order in a longitudinal direction of the ink ribbon 380, and each colored ink region extends in a widthwise direction of the ink ribbon 380. Colored hot melt ink is applied on the corresponding colored ink region of the ink ribbon 380.

When the thermal heads 350*y*, 350*m*, 350*c*, 350*k* selectively generate heat while the ink ribbon 380 is placed between the thermal head unit 350 and the transfer belt 311, hot melt ink is transferred from the ink ribbon 380 onto the transfer belt 311, thereby forming an ink image thereon. The transfer belt 311 formed with the ink image is transported toward a transfer unit 320 by rotational movement of a drive roller 313 and a tension roller 315. Then, the ink image is thermally transferred onto a recording sheet S by a heat roller 322 and a pressing roller 324. In this way, the ink image is formed on the recording sheet S.

While the invention has been described in detail with reference to specific embodiments thereof, it would be apparent to those skilled in the art that various changes and modifications may be made therein without departing from the spirit of the invention, the scope of which is defined by the attached claims.

For example, the ink jet printers and the thermal printer were described as the image forming device of the present invention. However, an electrostatic image forming device can be used.

Experimental tests performed shows that a silk image can be obtained by using an intermediate medium having a surface roughness Rz of is 5 μm or greater. However, if the surface roughness is 50 μm or greater, transfer of an ink image from the intermediate medium onto a recording sheet S will be extremely insufficient. Therefore, the intermediate medium preferably has a surface roughness Rz of between 5 μm and 50 μm, and optimally between 10 μm and 40 μm. With this configuration, a silk image can be formed without its quality being degraded. Also, the intermediate medium can be produced in a simple manner using shot blast techniques or molding techniques without requiring a highly-precise processing device.

The surface of the transfer belt can be coated with silicon ink-repellent rather than Teflon. Also, the transfer drum can be applied with oil fluoride, glycol coil, mineral oil, commodity oil, or water rather than silicon oil for forming a thin film. Also, the ink jet printer 200 can include a transfer drum rather than the transfer belt 290.

In the above-described third embodiment, the first hole 282*a* and the second hole 282*b* are formed on the transfer belt 211 for distinguishing the first region 211*a* and the second region 211*b*. However, the first region 211*a* and the second region 211*b* can be distinguished by detecting light reflection rates, which differ between the first region 211*a* an the second region 211*b*.

Further, the ink jet printer 200 of the third embodiment can include a transfer drum rather than the transfer belt.

In the above-described embodiments, the intermediate medium is driven to rotate for transferring the image formed thereon. However, an image forming device can include an intermediate medium fixed at a predetermined position without being driven to rotate. In this case, therefore, an image formed on the intermediate medium is not transported. The image is transferred onto a recording medium at the same position where the image is formed on the intermediate medium.

What is claimed is:

1. A transfer device comprising:

an intermediate medium having a surface having a surface roughness Rz of between 5 μm and 50 μm, the intermediate medium being formed with an image on the surface, the image being formed of phase-changeable ink; and a transfer unit that transfers the image from the intermediate medium onto a recording medium, wherein the image transferred from the surface of the intermediate medium, having the surface roughness Rz of between 5 μm and 50 μm, onto the recording medium is a silk image.

2. The transfer device according to claim 1, wherein the surface roughness of the intermediate medium is preferably between 10 μm and 40 μm.

3. The transfer device according to claim 1, wherein the surface of the intermediate medium includes a first region having a surface roughness Rz of 5 μm or greater and a second region having a surface roughness Rz of 1 μm or less.

4. The transfer device according to claim 1, further comprising a driving unit that drives the intermediate medium to rotate so as to transport the image on the intermediate medium to the transfer unit.

5. The transfer device according to claim 4, wherein the intermediate medium is a transfer drum driven to rotate by the driving unit.

6. The transfer device according to claim 4, wherein the driving unit comprises a pair of rollers, and the intermediate medium is an endless transfer belt wound around and spanning between the pair of rollers.

7. The transfer device according to claim 1, wherein the surface of the intermediate medium is coated with an ink-repellent layer, and the image is formed on the ink-repellent layer.

8. The transfer device according to claim 1, further comprising a liquid supply unit that supplies liquid onto the surface of the intermediate medium for forming a liquid layer on the surface, and the image is formed on the liquid layer.

9. The transfer device according to claim 1, wherein the transfer unit comprises a heater that applies heat to the intermediate medium and a presser that applies a pressure to the intermediate medium, and wherein the image is transferred from the intermediate medium onto the recording medium when applied with heat and pressure by the heater and the presser, respectively.

10. The transfer device according to claim 1, wherein the phase-changeable ink is hot melt ink that changes from a solid phase to a liquid phase when heated.

11. The transfer device according to claim 1, wherein the phase-changeable ink forming the image is transferred from a thermal transfer ink ribbon onto the surface of the intermediate medium when the thermal transfer ink ribbon is heated.

12. An image forming device comprising:

an intermediate medium having a surface roughness Rz of between 5 μm and 50 μm;

an image forming unit that forms an image onto the intermediate medium using phase-changeable ink; and a transfer unit that transfers the image from the intermediate medium onto a recording medium, wherein the image transferred from the surface of the intermediate medium, having the surface roughness Rz of between 5 μm and 50 μm, onto the recording medium is a silk image.

13. The image forming device according to claim 12, wherein the surface roughness Rz of the intermediate medium is preferably between 10 μm and 40 μm.

14. The image forming device according to claim 12, wherein the intermediate medium includes a first region having an average surface roughness Rz of 5 $\mu$m or greater and a second region having an average surface roughness Rz of 5 $\mu$m or less.

15. The image forming device according to claim 14, further comprising a selecting unit that selects one of the first region and the second region, wherein the image forming unit forms the image within the one of the first region an the second region selected by the selecting unit.

16. The image forming device according to claim 12, further comprising a driving unit that drives the intermediate medium to rotate so as to transport the image on the intermediate medium to the transfer unit.

17. The image forming device according to claim 16 wherein the intermediate medium is a transfer drum driven to rotate by the driving unit.

18. The image forming device according to claim 16, wherein the driving unit comprises a pair of rollers, and the intermediate medium is an endless transfer belt wound around and spanning between the pair of rollers.

19. The image forming device according to claim 12, wherein the intermediate medium is coated with an ink repellent layer, and the image is formed on the ink repellent layer.

20. The image forming device according to claim 12, further comprising a liquid supply unit that supplies liquid to the intermediate medium for forming a liquid layer, and the image is formed on the liquid layer.

21. The image forming device according to claim 12, wherein the phase-changeable ink is hot melt ink, and the image forming unit comprises a heater that generates heat to heat up the hot melt ink, the hot melt ink heated up by the heater changing from a solid phase to a liquid phase, and wherein the image forming unit forms the image onto the intermediate medium using the hot melt ink in the liquid phase.

22. The image forming device according to claim 12, wherein the image forming unit includes a thermal head for generating heat to heat a thermal transfer ink ribbon applied with the phase-changeable ink, the phase-changeable ink is transferred from the thermal transfer ink ribbon onto the intermediate medium when heated by the thermal head.

23. The image forming device according to claim 12, wherein the image forming unit includes an ink jet head for ejecting ink droplets of the phase-changeable ink onto the intermediate medium to form the image thereon.

* * * * *